US005586949A

United States Patent [19]

Aizawa

[11] Patent Number: 5,586,949

[45] Date of Patent: Dec. 24, 1996

[54] HOLLOW CLUB HEAD WITH SOLE PLATE SUPPORT STRUCTURE

[75] Inventor: Yuichi Aizawa, Tokyo, Japan

[73] Assignee: Daiwa Seiko, Inc., Tokyo, Japan

[21] Appl. No.: 510,099

[22] Filed: Aug. 1, 1995

[30] Foreign Application Priority Data

Aug. 5, 1994 [JP] Japan ..... 6-184399

[51] Int. Cl.[6] ..... A63B 53/04

[52] U.S. Cl. ..... 473/345; 473/349

[58] Field of Search ..... 273/167 R, 169, 273/171, 172, 173, 174, 167 A, 167 H, 80.2, 80.5; 473/324, 332, 334, 335, 345, 346, 344, 349

[56] References Cited

U.S. PATENT DOCUMENTS 4,714,577 12/1987 Nagamoto et al. ..... 273/167 H
4,809,978 3/1989 Yamaguchi et al. ..... 279/173
5,207,428 5/1993 Aizawa ..... 273/174
5,294,037 3/1994 Schmidt ..... 273/167 H
5,445,382 8/1995 Pearce et al. ..... 273/167 R
5,467,983 11/1995 Chen ..... 273/167 H

FOREIGN PATENT DOCUMENTS 63-264085 10/1988 Japan .
6-23070 2/1994 Japan .

*Primary Examiner*—William M. Pierce
*Attorney, Agent, or Firm*—Longacre & White

[57] ABSTRACT

The invention concerns a golf club head in which a sole plate secured to a sole portion is prevented from dislodgment therefrom, while keeping the center of gravity of the golf club head low. In the golf club head, a sole plate, made of a material greater in specific gravity than a metal head body formed into a hollow construction having a single internal chamber, is mounted on a sole portion of the head body. A support portion having a plurality of holes is formed integrally with the head body so that an upper surface of the sole plate is held against the support portion. In an embodiment, the support portion is formed into a lattice-shape.

13 Claims, 4 Drawing Sheets

HOLLOW CLUB HEAD WITH SOLE PLATE SUPPORT STRUCTURE

BACKGROUND OF THE INVENTION

This invention relates to a golf club head of the type in which a sole plate is prevented from dislodgment.

Recently, in view of the stability of quality, the ease of supply of materials and so on, metal golf club heads (called "wood"), in which a head body of a hollow construction is cast of metal such as stainless steel and an aluminum alloy, have been extensively used instead of golf club heads made of natural wood such as persimmon and cherry. Metal has a higher strength than wood, and therefore when a head body is thus cast into a hollow construction so that the weight is distributed over a peripheral portion of the head, a moment of inertia increases, thereby achieving a directional stability of a ball.

In order to increase a repulsive coefficient at the time of hitting a ball to thereby secure a flying distance, it has been proposed to mount a face plate of a fiber-reinforced resin onto a face portion of a head body. In order to adjust the weight of a golf club head, it has been proposed to mount a sole plate, cast of metal greater in specific gravity than a head body, onto a sole portion to thereby lower the center of gravity of the head. These and other measures have been adopted.

One conventional method of securing a sole plate, made of metal different from that of a metal head body, to the metal head body is to bond them together by an epoxy adhesive. In another conventional method as disclosed in Japanese Patent Unexamined Patent Publication No. 6-23070 and shown in FIG. 4, a sole plate 3, having a retaining portion 1, is integrally connected to a head body 5 to close a bottom opening in the head body 5 when casting the head body 5 of metal lower in melting point than the sole plate 3.

However, in the construction of bonding the sole plate by the adhesive, an adequate bonding strength can not be obtained, thus posing a problem with respect to durability. In the mounting construction shown in FIG. 4, the sole plate 3 and the head body 5 are merely engaged with each other through the recess and protrusion at the peripheral edge of the sole plate 3, and therefore when the sole plate 3 is caused to strike against the ground at the time of hitting a ball, there is a possibility that the sole plate 3 is dislodged into the hollow head body 5.

Japanese Patent Unexamined Publication No. 63-264085 discloses a golf head club 13 (see FIG. 5) in which a wall portion 9 of a cross shape in section is formed integrally within a hollow metal head body 7 by casting, and extends between a toe and a heel, between a face and a back, and between a top and a sole. This wall portion 9 divides the interior of the head body into four hollow chambers 11.

Assuming that this wall portion 9 is provided to serve as a reinforcement member for the sole plate, the sole plate 3 will not be dislodged into the hollow head body 7 even when the sole plate 3 is caused to strike against the ground at the time of hitting a ball.

However, in the case where the wall portion 9 is thus formed over a region between the top and the sole, the golf club head 13 has a high center of gravity, and this invites a drawback that it is difficult to easily hit a ball with this golf club.

SUMMARY OF THE INVENTION

The present invention has been made in view of the above problems, and an object of the invention is to provide a golf club head in which a sole plate secured to a sole portion is prevented from dislodgment therefrom, while keeping the center of gravity of the golf club head low.

The above object has been achieved by a golf club head which includes: a hollow metal head body having a single internal chamber; a recess portion formed in a sole portion of the head body, the recess portion having a bottom; and a sole plate made of material greater in specific gravity than the head body, the sole plate being mounted in the recess portion and contacting with the bottom; wherein the bottom has at least one hole.

The above object has also been achieved by a golf club head which includes: a hollow metal head body having a single internal chamber; and a sole plate made of material greater in specific gravity than the head body and attached to a sole portion of the head body, wherein: the sole portion has a support portion integral with the head body and kept in contact with an upper surface of the sole plate for preventing the sole plate from being dislodged into the internal chamber of the head body; and the support portion is formed with at least one hole to lighten weight of the support portion.

According to the invention, even if the sole plate is caused to strike against the ground when hitting a ball, the bottom or support portion is held against the sole plate to prevent the sole plate from being dislodged into the head body, thus reinforcing the whole of the sole plate.

DETAILED DESCRIPTION OF THE PREFERRED EMBODIMENT

A preferred embodiment of the invention will now be described in detail with reference to the drawings.

Figure 1:
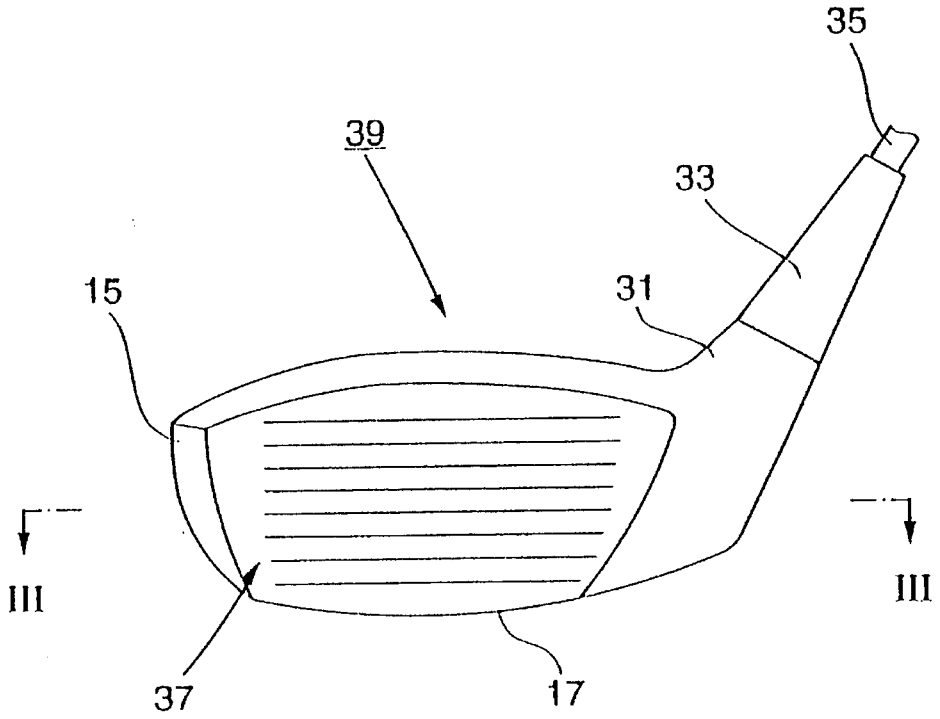
FIG. 1 is a front-elevational view of a golf club having a golf club head according to an embodiment of the present invention.
Figure 2:
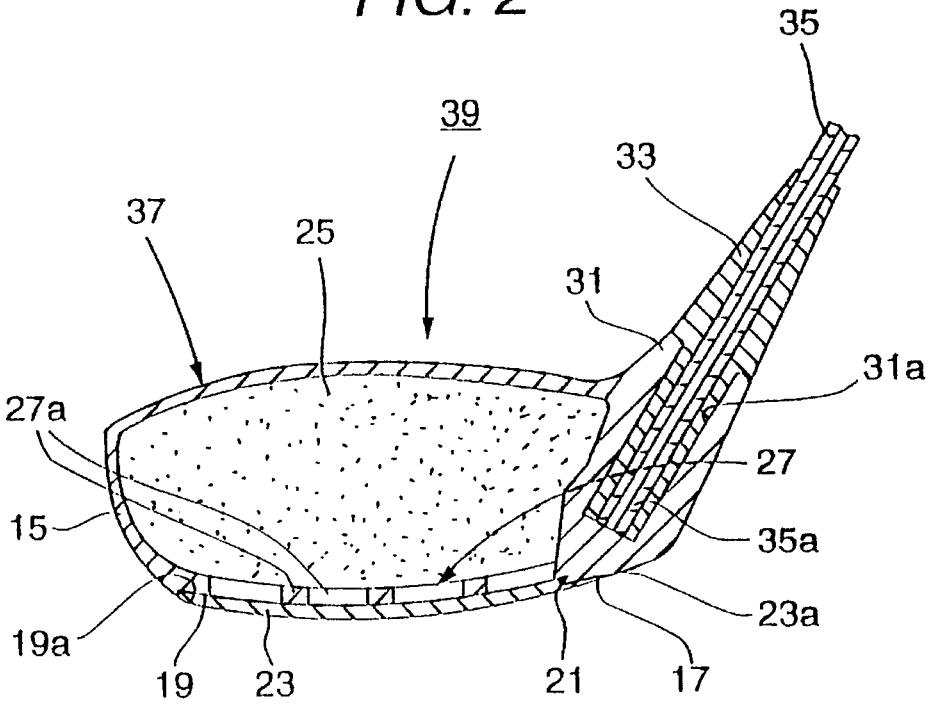
FIG. 2 is a vertical cross-sectional view of the golf club of FIG. 1.
Figure 3:
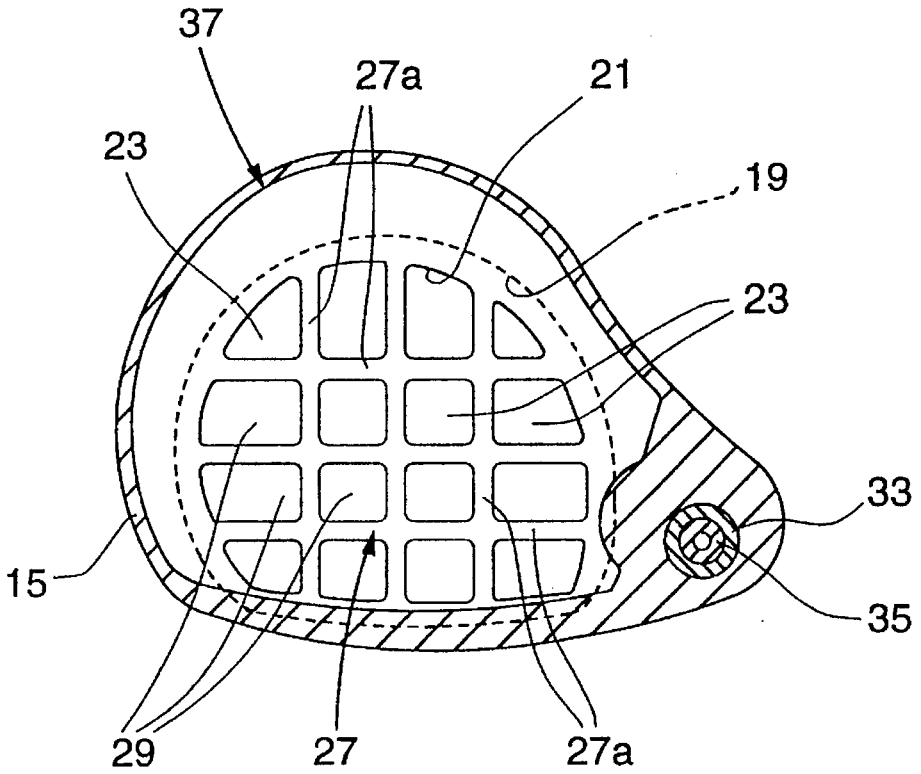
FIG. 3 is a cross-sectional view taken along the line III—III of FIG. 1.
Figure 4:
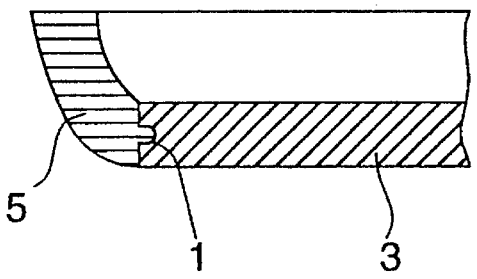
FIG. 4 PRIOR ART
FIG. 4 is a cross-sectional view of an important portion of a construction of mounting a sole plate in a conventional golf club head.

FIGS. 1 to 3 shows a preferred embodiment of a golf club head of the present invention. In FIG. 1, a hollow head body 15 is made of metal such as a magnesium alloy (Specific gravity: 1.8) and an aluminum alloy (Specific gravity: 2.8). As shown in FIGS. 2 and 3, a recess portion 19 is formed in a sole portion 17 to define an opening edge 21, a bottom (or support portion) 27 and a peripheral wall **19*a* connecting the opening edge 21 and the bottom 27**.

A sole plate 23 is mounted in the recess portion 19, and is disposed flush with the sole portion 17. The sole plate 23 is made of metal higher in melting point and specific gravity than the head body 15, such as stainless steel (Specific gravity: 7.8), a copper alloy (Specific gravity: 7.8~8.9), a nickel alloy (Specific gravity: 8.7) and a cobalt alloy (Specific gravity: 8.8). A filler 25 made of a foamed synthetic resin is filled in the interior of the head body 15 formed into a hollow construction having a single internal chamber.

As shown in FIG. 2, the peripheral wall 19*a* of the recess portion 19 is slanting outwardly from the opening edge 21 to the bottom 27. A peripheral edge 23*a* of the sole plate 23 conforms in configuration to the peripheral wall 19*a*. Although not shown in the drawings, for mounting the sole plate 23 in the recess portion 19, the sole plate 23 is first disposed in facing relation to the recess portion 19, and then is press-fitted into the recess portion 19 by a die, so that the peripheral edge 23*a* is deformed to conform to the peripheral wall 19*a*. Alternatively, the sole plate 23 is secured at its peripheral edge to the sole portion 17 of the head body 15 simultaneously when the head body 15 is cast.

As shown in FIG. 3, the bottom or support portion 27 is relatively thin in thickness and integral with the head body 15. The bottom or support portion 27 serves to support the sole plate 23 mounted in the recessed portion 19. The bottom or support portion 27 includes a plurality of support stays 27*a* arranged to form a grid shape, some of which extend from a toe side to a heel side of the head body 15 while the other support stays 27*a* extend from a face side to a back side of the head body 15. These support stays 27*a* contact with the upper surface of the sole plate 23 to thereby prevent the sole plate 23 from being dislodged into the head body 15.

As best shown in FIG. 3, the support stays 27*a* of the bottom or support portion 27 define a plurality of holes 29 which communicate the interior of the hollow head body 15 with the recessed portion 19. The support stays 27*a* are thus arranged in the form of a grid to provide the holes 29, and with this arrangement the bottom or support portion 27 can be made light in weight design.

As shown in FIG. 2, a hosel insertion portion 31 having a hosel insertion hole 31*a* extends obliquely upwardly from the head body 15 at the heel side thereof. A hosel 33 is inserted into the hosel insertion hole 31*a*, the hosel 33 being molded of a synthetic resin such as an ABS resin, a polycarbonate resin, an epoxy resin, and a mixture thereof with power of carbon, Kevlar or glass. A shaft 35, formed of metal or a resin such as FRP, is fixedly secured to the head body 15 through the hosel 33. The shaft 35 is thus secured to the head body 15 through the hosel 33 of a synthetic resin, and with this construction the hosel 33 serves as a cushioning member which absorbs vibrations developing when hitting a ball, and hence relieves these vibrations to be transmitted to the shaft 35 from the head body 15.

The hosel 33 may be beforehand fixedly fitted on an insertion-side end portion 35*a* of the shaft 35, and then the hosel 33, together with the shaft 35, is inserted into the hosel insertion hole 31*a*. Alternatively, the hosel 33 may be connected to the head body 15 independently of the shaft 35, and then the shaft 35 is inserted into the hosel 33.

With this construction of the golf club head 37 of this embodiment, when hitting a ball by a golf club 39 having this golf club head 37 mounted thereon, the ball is caused to fly with a good directional stability since the weight of the golf club head 37 is distributed over the peripheral portion thereof as in the conventional construction to thereby provide a large inertia of moment.

At this time, although vibrations due to the hitting of the ball develop at the golf club head 37, the hosel 33 absorbs these vibrations to thereby reduce the amount of transmission of the vibrations to the shaft 35.

Even if the sole plate 23 is caused to strike against the ground when hitting the ball, the plurality of support stays 27*a* of the bottom or support portion 27 are held against the upper surface of the sole plate 23 to prevent the sole plate 23 from being dislodged into the head body 15, thus reinforcing the whole of the sole plate 23.

Figure 5:
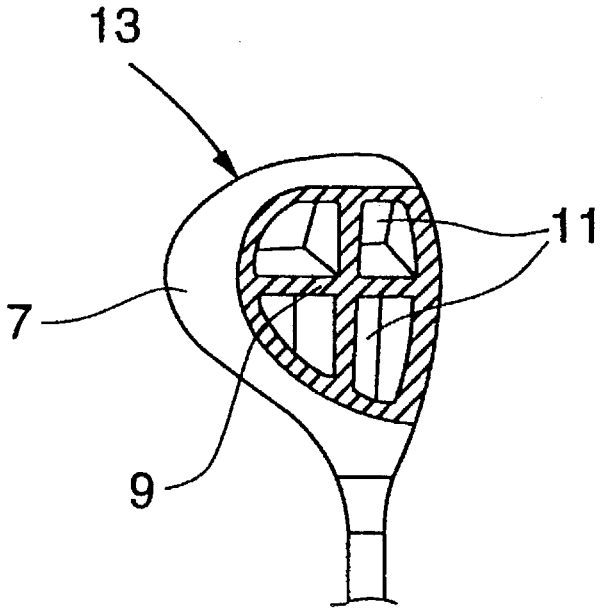
FIG. 5 PRIOR ART
FIG. 5 is a partly-broken, perspective view of a conventional golf club head.

And besides, unlike the wall portion 9 shown in FIG. 5, the bottom or support portion 27 is not provided over a region extending from the top to the sole of the head body 15, and therefore the center of gravity of the head body 15 is not disposed high, and the sole plate 23 serves as a weight-adjusting member to lower the center of gravity of the golf club head 37.

As described above, in the golf club head 37 of this embodiment, even if the sole plate 23 is caused to strike against the ground when hitting the ball, the sole plate 23 will not be dislodged into the head body 15, and besides damage to the sole plate 23 is prevented because of the reinforcement by the support portion 27.

Furthermore, in this embodiment, since the center of gravity of the golf club head 37 is kept low, it is not difficult to easily hit the ball, and the weight of the golf club head 37 is not increased since the plurality of holes 29 are formed through the support portion 27.

In the above embodiment, the sole plate 23 is made of metal higher in melting point and specific gravity than the head body 15; however, in the case where the sole plate 23 is not secured at its peripheral edge simultaneously when the head body 15 is cast, but the sole plate 23 is press-fitted into the recess portion 19 by a die, the sole plate 23 need only to be made of metal greater in specific gravity than the head body 15.

Figure 6:
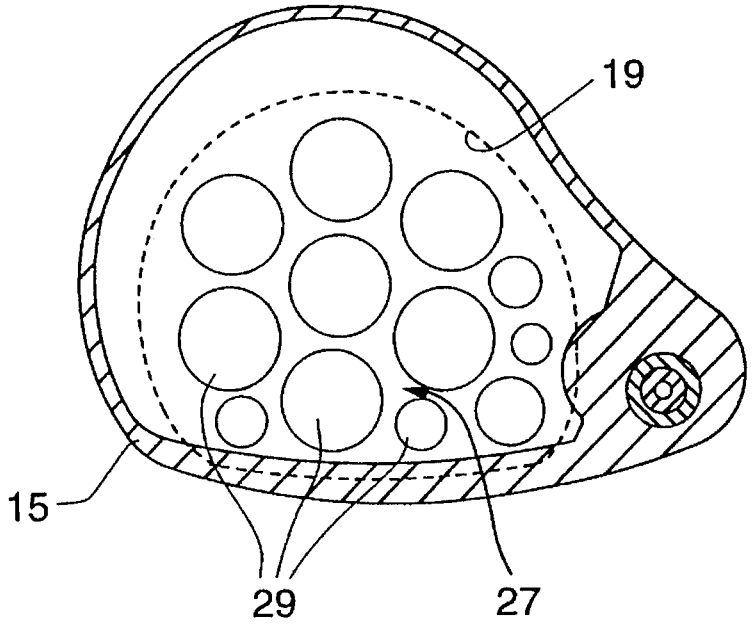
FIG. 6 is a cross-sectional view showing a modification of the golf club head of the invention.
Figure 7:
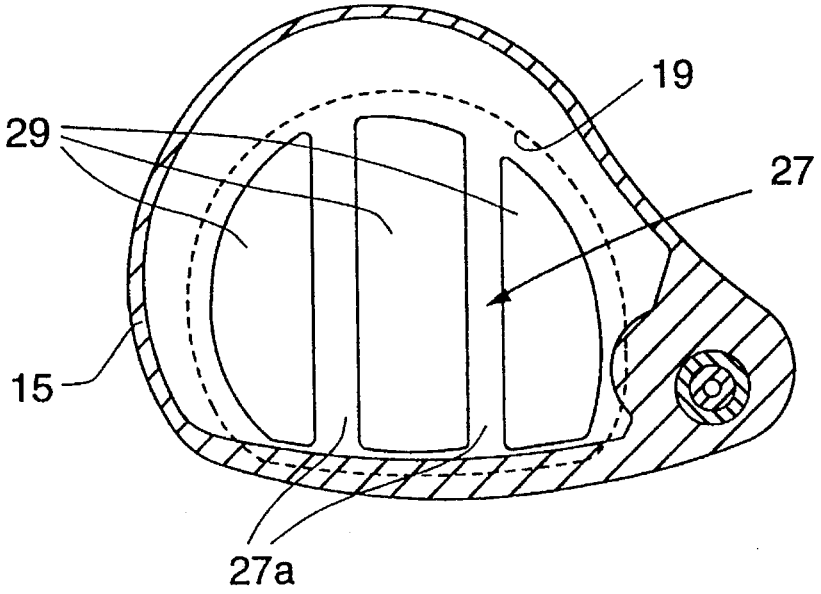
FIG. 7 is a cross-sectional view showing another modification of the golf club head of the invention.

In the above embodiment, although the support portion 27 is formed into a grid-shape over the sole portion 17 to provide the plurality of support stays 27*a* and the plurality of holes 39, the support portion 27 is not limited to the configuration shown in the above embodiment. Only one hole may be formed through the bottom or support portion 27 as long as it functions as the reinforcement for the sole plate 23 mounted in the recess portion 19. The plurality of holes may be arranged in an irregular pattern as shown in FIG. 6, in so far as the support portion is held against the upper surface of the sole plate 23. Further, one or more stays each extending from a toe side to a heel side or from a face side to a back side may be provided in the bottom or support portion 27 (FIG. 7 shows a case that two support stays 27*a* each extending from a face side to a back side is provided in the bottom or support portion 27 to define three holes 29. Furthermore, although each hole 29 of the embodiment and the modifications described before is a through-hole which communicates the interior of the hollow head body 15 with the recess portion 19, the hole 29 may be a blind hole opened to only one of the interior of the hollow head body 15 and the recess portion 19.

As described above, in the golf club head of the invention, the sole plate mounted on the sole portion is prevented from being dislodged, while keeping the center of gravity low. Therefore, even if the sole plate is caused to strike against the ground when hitting a ball, the sole plate will not be dislodged into the head body, and damage to the sole plate is prevented because of the reinforcement by the support member.

And besides, since the center of gravity of the golf club head is kept low, it is not difficult to easily hit a ball with this club, and since the plurality of holes are formed through the support portion, the golf club head does not have an increased weight.

In the golf club head in which the sole plate is mounted in the recess portion and is flush with the sole portion around the recess portion, even if the sole plate is brought into the ground when hitting a ball, the peripheral portion of the sole plate will not be caught by the ground.

In the golf club head in which the sole plate is securely mounted in the recess portion using the configuration of the peripheral wall of the recess portion, which outwardly slants from the opening edge to the bottom or support portion of the recess, even in the case where the sole plate and the head body joined together are made of different materials, respectively, the sole plate positively remains held in the recess portion, thus preventing the dislodgment of the sole plate.

In the golf club head in which the support portion has support stays arranged into a grid-shape or extending across the recess portion, the weight of the support portion is reduced.

In the golf club head in which the head body is formed to provide the hollow construction having a single internal chamber formed by a wall having a generally uniform thickness, the weight of the head body is reduced.

In the golf club head in which the head body is cast of one of a magnesium alloy and an aluminum alloy, the head body is made of the metal material having a relatively small specific gravity, and this is effective in lowering the center of gravity of the head.

In the golf club head in which the sole plate is made of one of stainless steel, a copper alloy, a nickel alloy and a cobalt alloy, the sole plate is made of the metal material greater in specific gravity than the head body, and therefore the sole plate serves as the weight-adjusting member to effectively lower the center of gravity of the head.

In the golf club head in which the hosel on the head body is made of the synthetic resin smaller in specific gravity than a metal material, the weight of the hosel is reduced, and this contributes to the lowering of the center of gravity of the head.

What is claimed is:

1. A golf club head comprising:

a hollow metal head body having a single internal chamber, said head body having a top surface;

a recess portion formed in a sole portion of said head body, said recess portion having a support portion; and a sole plate made of material greater in specific gravity than said head body, said sole plate being mounted in said recess portion and contacting with said support portion substantially along an inner surface; wherein said support portion extends into said single internal chamber no further than a midpoint between said top surface of said head body and said sole portion, and wherein said support portion comprises a plurality of stays extending across said recess in at least two directions and intersecting with each other to form a grid.

2. A golf club head according to claim 1, wherein said bottom has a plurality of holes communicating said internal chamber with said recess portion.

3. A golf club head according to claim 1, wherein said sole plate is flush with said sole portion of said head body.

4. A golf club head according to claim 1, wherein said head body has substantially uniform wall thickness.

5. A golf club head according to claim 1, wherein said head body is made of one of magnesium alloy and aluminum alloy.

6. A golf club head according to claim 1, wherein said sole plate is made of one of stainless steel, copper alloy, nickel alloy and cobalt alloy.

7. A golf club head according to claim 1, further comprising:

a hosel formed of a synthetic resin and secured to a heel portion of said head body.

8. A golf club head according to claim 1, wherein said bottom has a plurality of holes arranged in an irregular pattern.

9. A golf club head according to claim 1, wherein said bottom has a pair of support stays extending from a face side to a back side to define three holes.

10. A golf club head having a hollow metal head body defining a single internal chamber; said head body comprising:

a support portion;

a sole portion having a recess extending to said support portion; and a sole plate having a back surface disposed within said recess, said back surface having a peripheral surface and an inner surface, wherein said support portion contacts said sole plate substantially along both said peripheral and inner surfaces to prevent said back plate from dislodging into said internal chamber, wherein said support portion comprises a plurality of stays extending across said recess in at least two directions that intersect with each other to form a grid.

11. A golf club head according to claim 10, wherein said head body comprises a top surface and said support portion extends into said internal chamber no further than a midpoint between said sole portion to said top surface.

12. A golf club head according to claim 10, wherein said sole portion and said support portion are integrally formed with said head body.

13. A golf club head according to claim 10, wherein said support portion has a thickness measured in a direction form a sole side to a top surface of said head body, said thickness of said support portion being no greater than said uniform wall thickness of said head body.

* * * * *